United States Patent [19]

Chulick

[11] Patent Number: 4,538,683

[45] Date of Patent: Sep. 3, 1985

[54] MULTIPLE POINT GROUNDWATER SAMPLER

[75] Inventor: Eugene T. Chulick, Richmond, Tex.

[73] Assignee: The Babcock & Wilcox Company, New Orleans, La.

[21] Appl. No.: 590,615

[22] Filed: Mar. 19, 1984

Related U.S. Application Data

[63] Continuation-in-part of Ser. No. 461,313, Jan. 27, 1983, abandoned.

[51] Int. Cl.[3] ..... E21B 49/08

[52] U.S. Cl. ..... 166/264; 166/191

[58] Field of Search ..... 166/264, 191, 106, 369, 166/330, 316, 73; 73/155

[56] References Cited

U.S. PATENT DOCUMENTS

| | | | |
|---|---|---|---|
| 2,751,016 | 6/1956 | Watzlavick | 166/264 X |
| 2,781,663 | 2/1957 | Maly et al. | 166/264 X |
| 2,942,668 | 6/1960 | Maly et al. | 166/191 |

*Primary Examiner*—James A. Leppink
*Assistant Examiner*—Thuy M. Bui
*Attorney, Agent, or Firm*—Robert J. Edwards; Mark B. Quatt

[57] ABSTRACT

A multiple point groundwater sampler in which a rotatable inner cylinder has perforations which selectively align with the perforations of an outer cylinder to provide for sampling at individual horizons within a well casing, and means to withdraw the sample from the inner cylinder.

3 Claims, 7 Drawing Figures

FIG. 2
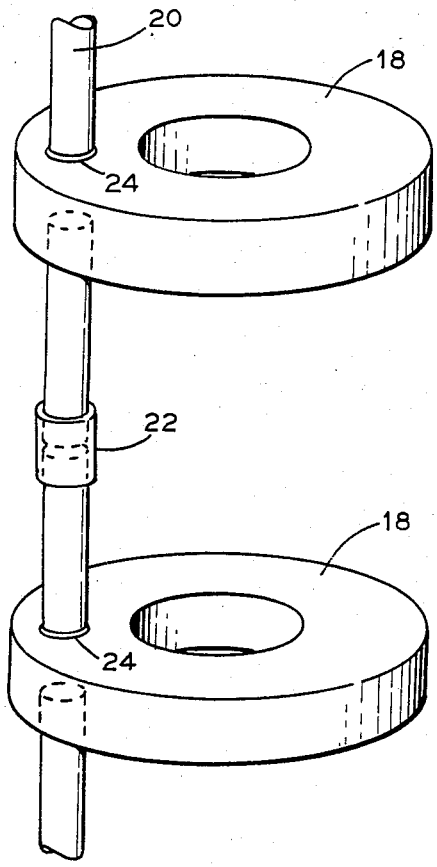
FIG. 3
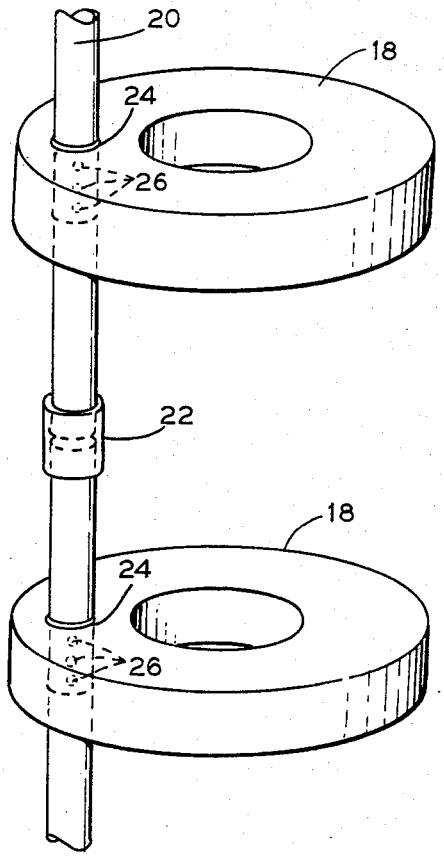
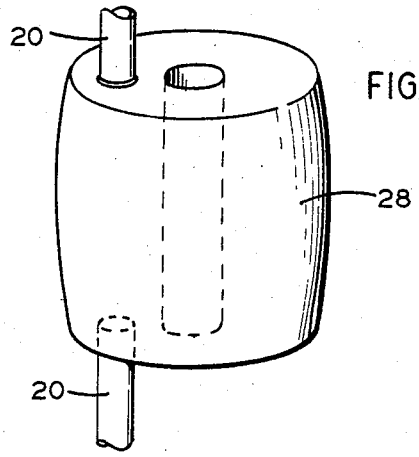
FIG. 4

MULTIPLE POINT GROUNDWATER SAMPLER

This application is a continuation-in-part of U.S. patent application Ser. No. 461,313, filed Jan. 27, 1983, now abandoned.

BACKGROUND OF THE INVENTION

1. Field of the Invention

The present invention relates to a device and process for sampling groundwater within a single monitoring well. More particularly, this invention relates to sampling of groundwater at several horizons independently within the monitoring well.

2. Description of Prior Art

It is often desirable to obtain samples of groundwater at various horizon locations within a well. In the past, multiple wells or complicated single well multiple sampling devices were required to accomplish multi-horizon sampling. These devices involve an elaborate system of sample lines and permanent packing or fragile small cross-section samplers placed on the well casing before its placement, requiring precise knowledge of horizon locations prior to casing installation. Sample cross-contamination between horizons can often occur with the use of existing devices. Furthermore, sample oxidation and/or degasification, which can ruin a sample value, are problems which may arise through the use of some existing devices for groundwater sampling.

An example of the prior art is U.S. Pat. No. 3,384,170 (Van Poollen) which discloses a sampler with a vertically stacked series of relatively small sampler chambers which fill simultaneously during sampling by means of apertures in each chamber and perforations in a cylindrical sleeve in communication with perforations in the well casing. The entire sampling unit, including the stacked series of sampler chambers, is then removed from the sleeve for testing. Van Poollen '170 relies primarily on vertical displacement of the sampler, relative to the cylindrical sleeve, to effect communication with the respective sampling horizon.

SUMMARY OF THE INVENTION

The present invention provides a device for sampling groundwater at individual horizons within a multiple point monitoring well. An outer cylinder has a plurality of screened perforations. An inner cylinder is concentrically arranged within and contiguous with the outer cylinder, and has a plurality of screened perforations offset with respect to the first set of perforations. In operation, the inner cylinder is rotated about its longitudinal axis, thereby aligning, in sequence, screened perforations of the inner and outer cylinder to establish communication with each individual horizon, in turn, for sampling the groundwater at each individual horizon independently.

Selective sampling at a particular horizon is thus possible, each horizon in turn being sampled according to a pre-determined sequence, and each sample may be removed from the inner cylinder by pumping means before the next sample is taken.

BRIEF DESCRIPTION OF THE DRAWINGS

In the accompanying drawings, forming a part of this specification, and in which reference numerals shown in the drawings designate like or corresponding parts throughout the same.

FIG. 2 is a perspective view of typical inflatable annuli and gas lines made in accordance with the invention;

FIG. 3 is an alternate embodiment of typical inflatable annuli and gas lines;

FIG. 4 is a perspective view of still another inflatable annulus and gas lines.

DESCRIPTION OF THE PREFERRED EMBODIMENTS

Figure 1:
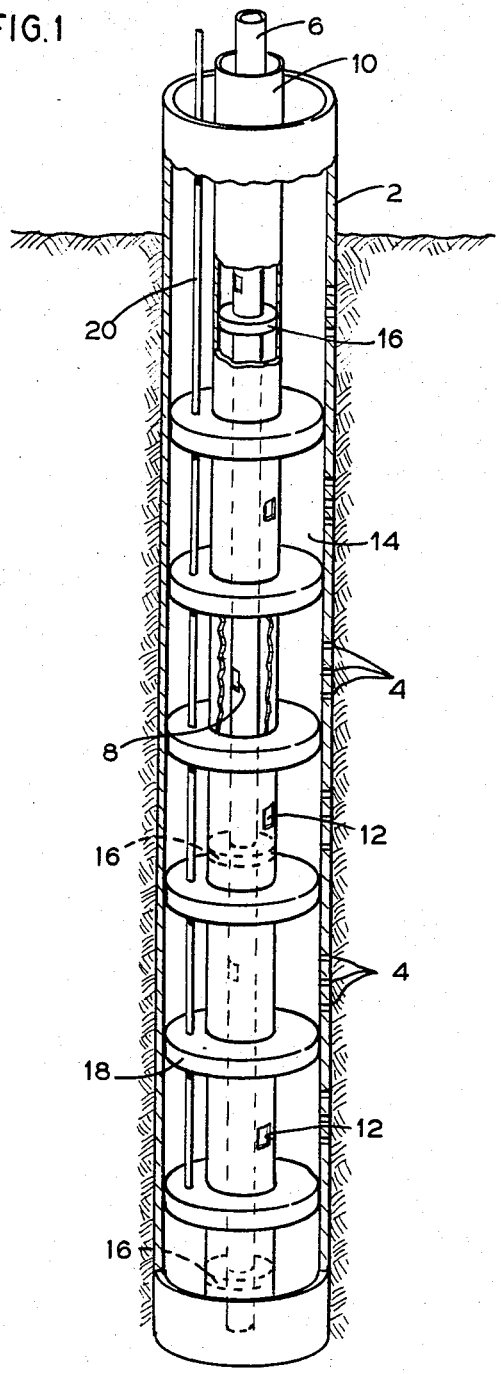
FIG. 1 is a perspective view of a multiple point groundwater sampler made in accordance with the invention.

Referring to FIG. 1, the well casing 2 within the monitoring well contains well casing screen 4 at several locations along the length of the monitoring well coinciding with aquifer sample horizons 14.

Figure 6:
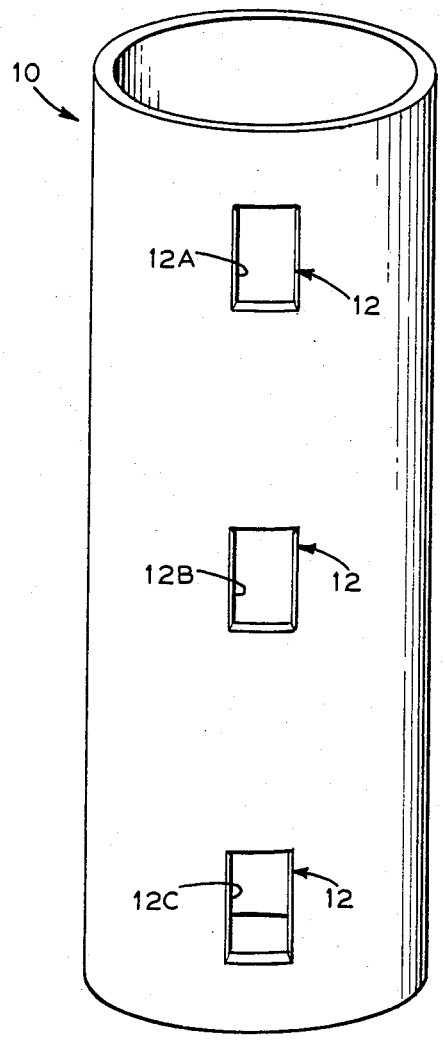
FIG. 6 is an enlarged perspective view of the outer cylinder in accordance with the invention.
Figure 7:
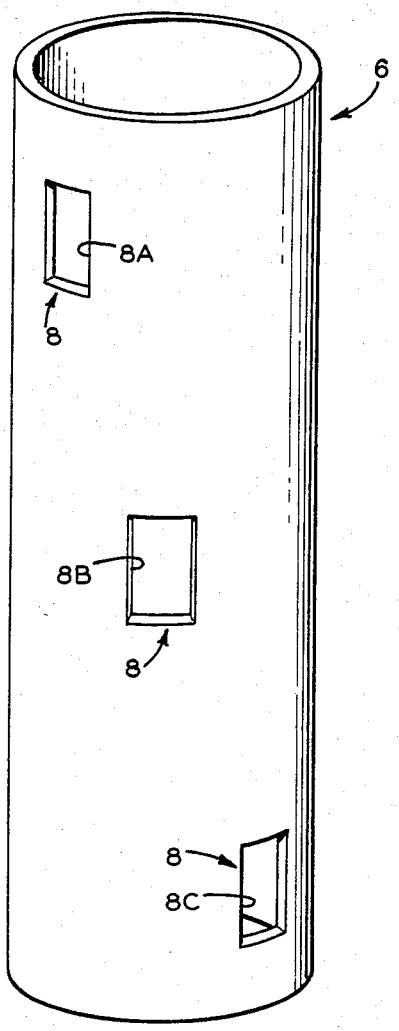
FIG. 7 is an enlarged perspective view of the inner cylinder in accordance with the invention.

An inner cylinder 6, shown in FIG. 1 in a generally longitudinal alignment, contains a first plurality of screened perforation 8. These perforations are offset along the length of the inner cylinder 6. An outer cylinder 10 is concentrically arranged about said inner cylinder, and contains a second plurality of screened perforations 12. FIGS. 6 and 7 show a possible alignment of screens in respective cylinders 6 and 10. With the cylinders in their relative positions during a sampling cycle, rotation of inner cylinder 6 within outer cylinder 10 in a clockwise direction (viewed from above the cylinders) will sequentially align screened perforations 8A and 12A; 8B and 12B; and 8C and 12C. Thus pairs of screened perforations will align, starting near the top of the cylinders and finishing near the bottom of the cylinders. Rotation of inner cylinder 6 may be accomplished manually. Alternatively, an automatic motorized sequencer (not shown) could be coupled to the inner cylinder and phased with the operation of the fluid pump to sequentially sample the horizons. The inner cylinder is rotatable about its longitudinal axis. The first set of screened perforations 8 is offset with respect to the second set of screened perforations 12, and both are so arranged on their respective cylinders that upon rotation of the inner cylinder 6 perforations 8 and 12 are selectively aligned permitting communication with an individual horizon 14. At the same time, fluid communication between other horizons 14 and the inner cylinder 6 is prevented. Isolation of each horizon is thus achieved. For purposes of illustration, inner cylinder 6 is pictured in FIG. 1 with a much smaller diameter than outer cylinder 10. These cylinders are actually only slightly different in diameter, and contiguous along the outer surface of the inner cylinder 6 and the inner surface of the outer cylinder 10. During the period in which selective first and second screened perforations are aligned within an individual horizon, the groundwater from that horizon will flow through both perforations and into the inner cylinder 6. The sample is then pumped to the surface by pumping means further described below.

While the arrangement of the perforations of the inner and outer cylinders prevents contamination of a sample within the inner cylinder during a particular sampling step, means must be provided to assure that cross-contamination is avoided between horizons, i.e. in the volume between the outer cylinder and the well casing within each horizon. This is accomplished by a packing means disposed at intervals along the length of the sampling device. FIGS. 2, 3, and 4 show alternate packing means which serve this purpose. Referring to FIG. 2, doughnut-shaped inflatable annuli 18 are wrapped about the outer cylinder 10 and positioned at several locations along the length of the sampling device. A suitable gas is pumped into the annuli which expand until a fluid-tight relationship between the well casing 2 and the outer cylinder 10 is achieved. In this arrangement, each horizon 14 is segregated from adjacent horizons and cross-contamination between horizons is avoided. The annuli are connected by segments of gas line 20. The segments are connected at points between each pair of annuli 18 by conventional quick disconnect tight fittings 22 or other tight fittings suitable for this purpose. The gas line 20 may be fitted and sealed into the top and bottom of each annulus by means of valve seal 24 as shown in FIG. 2. Alternately, as in FIG. 3, a vented gas line segment 26 may be fitted through each annulus with openings for gas passage in the tubing in the annulus. FIG. 4 illustrates still another embodiment with a barrel shaped extended annulus 28.

Figure 5:
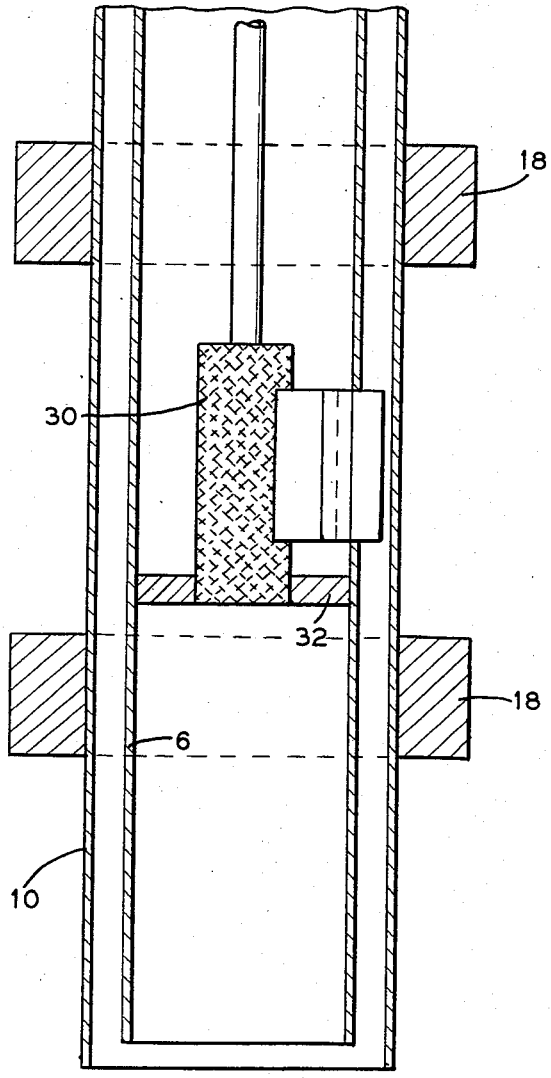
FIG. 5 is an enlarged sectional elevation showing the relationship of the pumping means to the sampling device.

Referring to FIG. 5, a pumping means 30 will typically be positioned within the inner cylinder and directly adjacent the selective first and second perforations in alignment during a particular sampling sequence. Several types of pumps may be used in conjunction with the present invention. Peristaltic pumps are preferred where sample degassing and or contamination may be a problem. These devices are suitable for shallow wells, i.e. less than 100 feet. At greater depths, submersible or liquid suction type pumps may be used with the proposed sampler. An example of a peristaltic pump would be the Masterflex® pump manufactured by the Barnant Corporation. Thus, at FIG. 5, reference 30 will represent either a submersible pump or the screen for a non-submersible pump, such as a peristaltic or liquid suction type pump. In cases where it is desirable to avoid fluid accumulation in the lower part of the inner cylinder, an optional pump annulus 32 may be used in conjunction with the pumping means. This annulus is inflatable and may be used to isolate a particular sampling horizon during the sampling step. An industrial embodiment of such a pump annulus is the pneumatic packer/pumping unit sold by Tigre Tierra, Inc.®.

The pumps just described extend the capability of the sampling device up to 500 feet with a minimum of sample degassing or cross-contamination. Of course the peristaltic and liquid suction type pumps will be operated from the surface to sample each horizon.

It should be noted that a greater number of sample locations can be obtained by moving the inner cylinder along its longitudinal axis within the outer sampling cylinder. However, the principle means of establishing sample locations is through selective location of the first screened perforations on the inner cylinder, the second screened perforations on the outer cylinder, positioning of the inflatable annuli, and degree of rotation of the inner cylinder about its longitudinal axis.

Various materials may be used for components of the present device. An optional low friction journal bearing 16, as shown in FIG. 1, may be employed at several locations along the length of the sampling device, on the inner cylinder, to reduce friction between the inner and outer cylindrs during a sampling sequence. These journal bearings may be made of, for example, teflon. Friction between the inner and outer cylinders may also be reduced by constructing these cylinders from teflon or plastic material.

A major advantage of the present invention is the mobility of the sampling device, which may be moved from well to well and completely removed when the sampling is terminated. Various diameter well casings can be accommodated, and the device involves few moving parts and simplified construction. Another advantage is the relatively large volume of groundwater that may be sampled from each horizon.

With reference to the gas line 20 for inflating the inflatable annuli, nitrogen or other inert gases may be used to pressurize the annuli to prevent sample and well contamination in case of an inflating gas leak.

Certain features of this invention may sometimes be used to advantage without a corresponding use of the other features. It is also to be understood that the invention is by no means limited to the specific embodiments which have been illustrated and described herein, and that various modifications may indeed by made within the scope of the present invention as defined by the claims.

The embodiments of the invention in which an exclusive property or privilege is claimed are defined as follows:

1. A device for sampling groundwater at individual horizons independently within a multiple screened monitoring well comprising: an inner cylinder having a first plurality of screened perforations; an outer cylinder concentrically arranged about and contiguous with said inner cylinder, and having a second plurality of screened perforations; the perforations in one of the said plurality of screened perforation being circumferentially offset; means for rotating the inner cylinder about its longitudinal axis to sequentially align selective first and second screened perforations thereby establishing communication with each individual horizon to allow the flow of groundwater through said first and second screened perforations into the inner cylinder; pumping means in communication with the inner cylinder is removing each groundwater sample from the inner cylinder; and packing means for isolating each individual horizon from other horizons within the monitoring well.

2. A device as in claim 1 wherein the packing means comprises inflatable annuli which substantially eliminate cross-contamination between the individual horizons within the monitoring well.

3. A method of sequentially sampling groundwater at individual horizons independently within a multiple screened monitoring well comprising the steps of:

positioning a sampling device within the well bore, said sampling device having an inner cylinder and an outer cylinder with, respectively, a first and second plurality of screened perforations thereon; the perforations in one of the said plurality of screened perforations, being circumferentially offset; inflating annuli at intervals corresponding to and defining the individual horizons to be monitored; rotating the inner cylinder of the sampling device about its longitudinal axis to sequentially align selective first and second screened perforations thereby establishing communication with each individual horizon to allow the flow of groundwater through said first and second screened perforations into the inner cylinder; and pumping each groundwater sample from the inner cylinder.

* * * * *